US006183073B1

(12) United States Patent
Rottman et al.

(10) Patent No.: US 6,183,073 B1
(45) Date of Patent: Feb. 6, 2001

(54) METHOD AND APPARATUS FOR POSITIVE PRESSURE FILLING A PRINTBAR

(75) Inventors: Robert M. Rottman, Ontario; Brian S. Hilton, Rochester, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/232,819

(22) Filed: Jan. 19, 1999

(51) Int. Cl.[7] ..... B41J 2/175
(52) U.S. Cl. ..... 347/85
(58) Field of Search ..... 347/7, 84, 85, 347/86, 87

(56) References Cited

U.S. PATENT DOCUMENTS

| | | | | |
|---|---|---|---|---|
| 3,930,258 | * | 12/1975 | Dick et al. | 346/75 |
| 4,240,082 | | 12/1980 | Yu | 346/75 |
| 4,301,460 | * | 11/1981 | Miura et al. | 347/21 |
| 4,463,359 | | 7/1984 | Ayata et al. | 347/56 |
| 4,714,937 | | 12/1987 | Kaplinsky | 347/86 |
| 5,359,356 | | 10/1994 | Ecklund | 347/86 |
| 5,621,445 | | 4/1997 | Fong et al. | 347/87 |
| 5,691,753 | | 11/1997 | Hilton | 347/85 |

* cited by examiner

*Primary Examiner*—N. Le
*Assistant Examiner*—Anh T.N. Vo
(74) *Attorney, Agent, or Firm*—Oliff & Berridge, PLC

(57) ABSTRACT

A printbar, such as a full width array printbar, filling method and apparatus provides for the selective application of positive pressure to an ink container, such as an ink bag, for forcing the expulsion of ink out of the bag and into the printbar. A steady force is applied until ink appears in a window provided in a vent line adjacent to and in fluid communication with the printbar, at which time the printbar manifold is full. Additional steady pressure forces ink to flow into the ink jet channels, assuring that the channels are fully primed and functional, at which time the positive pressure can be stopped. In an alternative embodiment, a motive force provided by, for example, a solenoid or motor, preferably including a gear and cam, are included to provide the motive force for the application of pressure against the ink bag. Pressure limiting springs may be utilized to provide the desired positive pressure to the ink manifold. A reflective light sensor may be included to detect ink in the vent line window and automatically turn off the motor or solenoid, preferably after a delay to allow priming of the channels.

23 Claims, 7 Drawing Sheets

METHOD AND APPARATUS FOR POSITIVE PRESSURE FILLING A PRINTBAR

BACKGROUND OF THE INVENTION

1. Field of Invention

This invention relates to filling a printbar with ink. More particularly, this invention is directed to methods and apparatus that initially fill the printbar, such as a full width array printbar, with ink using positive pressure.

2. Description of Related Art

Thermal ink-jet printers generally include a plurality of thermal printheads for ejecting ink onto a recording medium, such as, for example, paper. Each thermal printhead has a resistor to selectively vaporize ink near the nozzle of a capillary-filled ink channel. The vaporized ink forms a bubble that temporarily expels an ink droplet and propels it toward the paper. These types of thermal heads are incorporated in either a carriage-type printer or a page width or full width array (FWA) type printer.

U.S. Pat. No. 5,359,356 to Ecklund describes the use of a slidable primer rod featuring a plunger which uses gravity to assist in collapsing a flexible ink bag for an ink jet printer. The only force applied to the ink container is the weight of the rod and plunger. U.S. Pat. No. 5,621,445 to Fong et al. and U.S. Pat. No. 4,714,937 to Kaplinsky also describe printers featuring flexible ink containers. U.S. Pat. No. 4,240,052 to Yu describes a momentumless shutdown of a jet drop printer in which a positive pressure is created in an ink manifold by a pump located prior to the manifold.

SUMMARY OF THE INVENTION

The page width or full width array (FWA) printer includes a stationary printbar with a length equal to or greater than the width of the paper. The paper is continuously moved past the printbar at a constant speed or in a stepwise manner during the printing process. U.S. Pat. No. 4,463,359 to Ayata et al., the disclosure of which is incorporated herein by reference in its entirety, provides an example of a page width printhead. The paper is supported on the platen and located adjacent to the printbar to remain a precise distance away from the thermal printhead nozzles. The platen either supplies the motive force to the paper to convey the sheets past the printbar or acts as a support.

To improve their material compatibility life, full width array (FWA) printbars are usually shipped dry of ink. U.S. Pat. No. 5,691,753 to Hilton, the disclosure of which is incorporated herein by reference in its entirety, describes a valving connector and ink handling system for thermal ink jet printbars. An initial filling operation is required when the printbar is installed into the machine before the system becomes functional.

In one printbar filling method, a vacuum or suction system or the like provides negative pressure, which is applied to a manifold exhaust port to pull ink from the ink supply. The ink supply is typically located below the printbar. This conventional method can incidentally and undesireably draw air into the manifold through the ink jets. It is important that the manifold is filled only with ink to the greatest extent possible, as air bubbles can interfere with the delivery of ink into the channels, potentially leading to print quality degradation.

A positive pressure fill can be accomplished by raising the ink supply above the printbar and allowing the ink to flow down into the manifold under the force of gravity. However, the ink supply is typically stationary and space considerations often will not allow the ink supply to be raised higher than the printbar. Consequently, it is frequently not possible to supply the ink to the printbar using gravity alone.

This invention provides methods and apparatus that fill a printbar using positive pressure.

According to one exemplary embodiment of the methods and apparatus of this invention, a full width array (FWA) printbar is filled with ink by the application of a steady force of pressure against the ink supply. The pressure must be great enough to force the ink over the static head height of the system. The pressure forces the ink into the printbar manifold. The force is preferably additionally applied until ink appears in a ventline window, at which time the printbar manifold is completely filled with ink. Continued applied positive pressure forces ink to flow into the ink jet channels, assuring that the channels are primed and ready for regular operation. The channels could also be primed using a vacuum priming system.

In a second exemplary embodiment of the apparatus of this invention, a solenoid or a motor, including a gear and a cam, provide the motive force to create the pressure against the ink supply. Pressure limiting springs may provide the desired positive pressure against the ink supply to fill the ink manifold. A "Fill Printbars" switch or button may be provided to operate the positive pressure ink filling apparatus. A reflective light sensor may be used to detect ink in the ventline window and automatically deenergize the positive pressure ink filling apparatus. A delay may be provided to delay the amount of time prior to the deenergizing of the positive pressure ink filling apparatus to allow the printbar ink channels to become fully primed.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following drawing figures, in which.

DETAILED DESCRIPTION OF PREFERRED EMBODIMENTS

Figure 1:
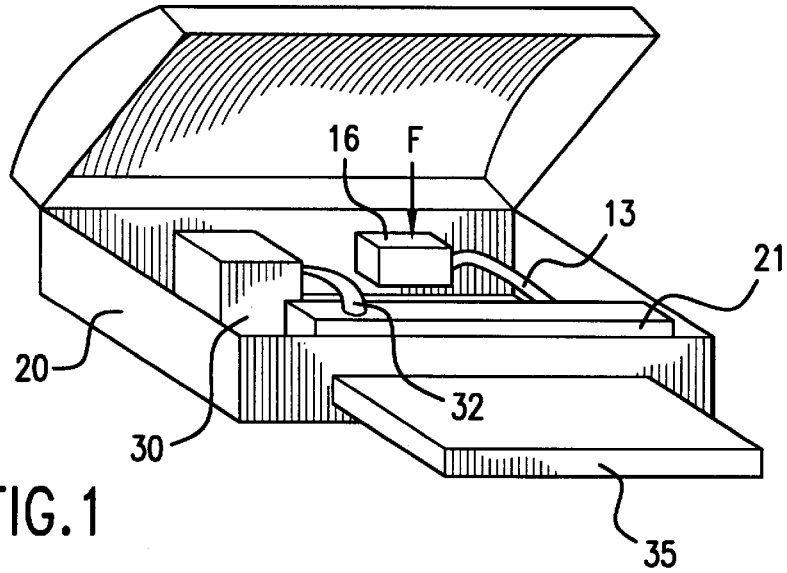
FIG. 1 is a perspective view of a printer containing one exemplary embodiment of the positive pressure ink filling apparatus of this invention.

FIG. 1 generally shows a printer 10 including one exemplary embodiment of the positive pressure ink filling system of this invention. Paper (not shown) is loaded into a paper tray 35, which is inserted into a printer case 20. The paper moves past a full width array (FWA) printbar 21, which jets ink onto the paper in response to signals from a controller 30 via a ribbon connector 32. Ink is stored in a container 16, and is supplied to the printbar 21 by a connector system 13, which may be conventional tubing or the like.

Figure 2:
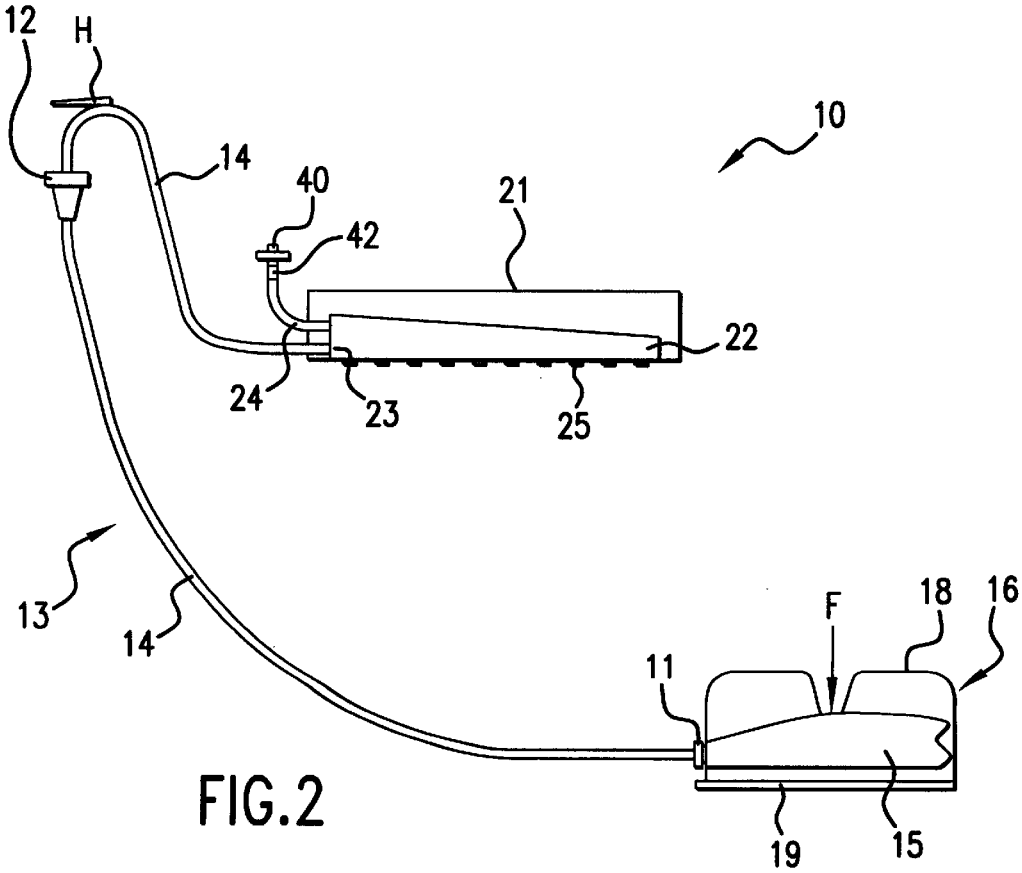
FIG. 2 shows one exemplary embodiment of a manual positive pressure ink filling apparatus of this invention.

FIG. 2 shows one exemplary embodiment of a manual positive pressure ink filling apparatus usable with the printer 10. As shown in FIG. 2, the ink container 16 is preferably formed by an ink bag 15, supported from below by a preferably rigid tray or bottom section 19. The tray bottom 19 is preferably covered by a flexible material cover or top section 18. The top section 18 may be removed from the bottom section 19 for replacing the ink bag 15, when necessary. The top and bottom sections 18 and 19 provide a soft section, e.g., the top section 18, which can be compressed against a rigid section, e.g., the bottom section 19, to squeeze the ink contained in the ink bag 15 between the top and bottom sections 18 and 19. The top and bottom sections 18 and 19 also may help to contain any ink that leaks from the ink bag 15, although it is not necessary that they do so. It is necessary to squeeze out enough of the ink to move the ink through the connector system 13 and to prime the channels of the printbar 21.

The squeezing pressure can be applied by a human hand or finger (not shown) pressing against the top section 18 and forcing a portion of the ink out of the ink container 16. It is also possible to press directly against the outside of the ink bag 15 to squeeze out the ink, in which case the ink bag 15 itself forms the ink container 16.

The connector system 13, which provides for liquid communication between the ink supply 16 and the printbar 21, is preferably formed by an ink line 14, one portion of which is attached to the ink bag 15 by a connector system 11. The other end of the first portion of the ink line 14 is preferably attached to a filter 12. A second portion of the ink line 14 connects the filter 12 to an entrance connector 23 of the printbar manifold 22. The static head H is the highest point in the ink line system. The filter 12 may optionally be provided in the ink line 14 to filter impurities from the ink.

The ink line 14 is connected to the printbar manifold 22 through the connector 23. A vent line 24 leads to a check valve 40. The check valve 40 allows air to be vented as the system becomes pressurized. Once the air is vented, ink is prevented from reflowing after the pressure is removed. In alternative embodiments, rather than or in addition to using a vent, a sump or pad could be provided to allow excess ink to flow out of the system to a waste or recycle system, for example.

A sight level window 42 can be provided in the vent line 24. When the printbar manifold 22 is full, ink will appear in the sight level window 42. This allows a person to know when to stop applying pressure on the ink bag 15 to the print manifold 22.

The full width array printbars 21 are usually shipped dry of ink. The static head height, H, is the highest point in the ink supply system. To fill the full width array printbar 21 with ink, a selective force, F, great enough to force a portion of the ink past the static head height, H, is applied to the ink container 16. This forces ink into the printbar manifold 22. The force F is applied until ink appears in the ventline window 42, at which time, the printbar manifold 22 is completely filled with ink.

Figure 9:
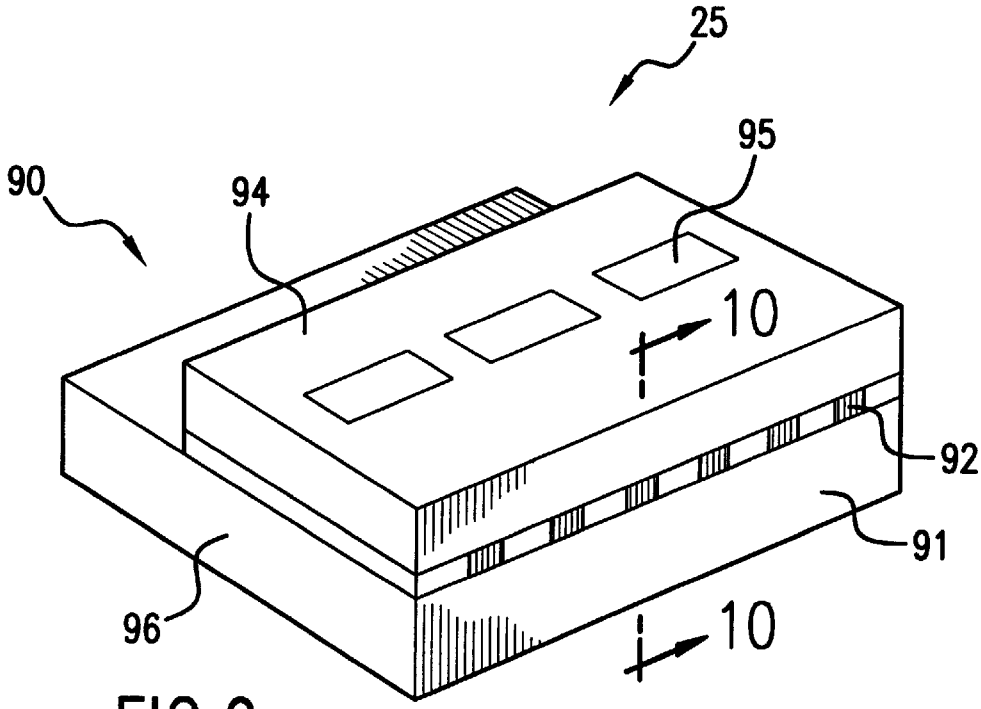
FIG. 9 is a perspective view of one exemplary embodiment of a printer die apparatus of this invention.
Figure 10:
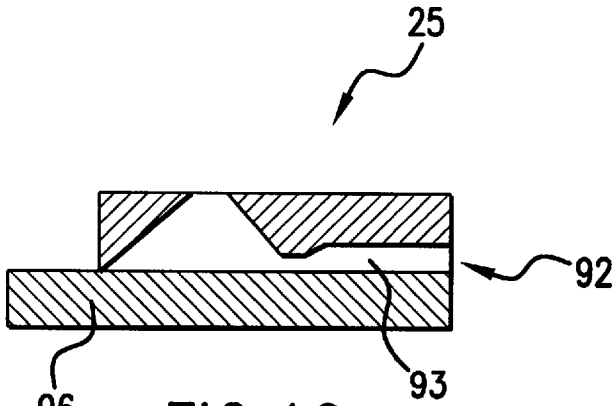
FIG. 10 is a cross-sectional view of a printer die apparatus of this invention, taken from perspective 10—10 of FIG. 9.

A printer die module 25 is shown in detail in FIGS. 9 and 10. The die module 25 defines a plurality of ink nozzles 92 in the front face 91 of the die 25. Six nozzles are representatively shown, although any number of nozzles may be included. The ink nozzles 92 extend from ink channels 93. The die includes a channel plate 94 which defines a plurality of ink inlets 95 (three inlets shown) and a heater plate 96 which preferably contains the electronics and heating elements for jetting the ink. A polyimide layer 97 is preferably located between the channel plate 94 and the heater plate 96.

Additional positive pressure is preferably applied to force additional ink into the channels 93 and to assure that the channels 93 are primed and ready for regular operation. The force can be selectively applied and stopped as necessary. Once the channels 93 are fully primed and the printer 10 is ready to be operated, the pressure F is discontinued, and ink will be used by the ink jets of the printbar. A capillary refilling will conventionally continue to siphon ink from the ink supply to replenish ink used by the ink jets. A negative pressure will prevent the ink from seeping out.

Figure 3:
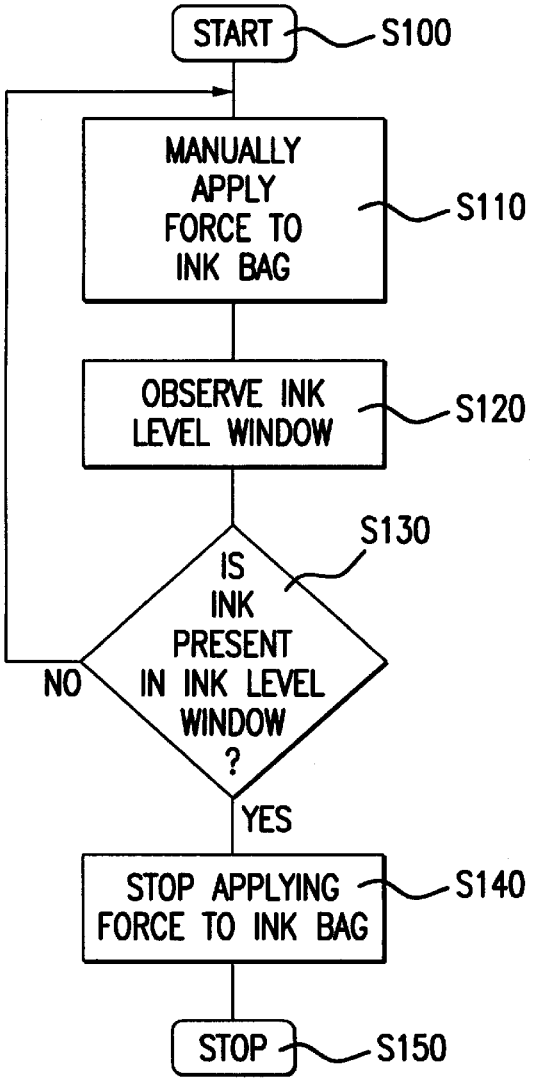
FIG. 3 is a flowchart outlining one exemplary embodiment of a manual positive pressure ink filling method of this invention.

FIG. 3 outlines one exemplary embodiment of a method for manually filling a print bar with ink using positive pressure according to this invention. Beginning in step S100, the method continues to step S110, where force is manually applied to an ink bag. Next, in step S120, the ink level window is observed. Control then continues to step S130. In step S130, a determination is made whether ink is present in the ink level window. If, in step S130, no ink is observed in the ink level window, control jumps back to step S110, and force is continued to be applied to the ink bag. Otherwise, if ink is observed in the ink level window, control continues to step S140.

In step S140, the force is removed from the ink bag. Then, in step S150, the method ends.

Figure 4:
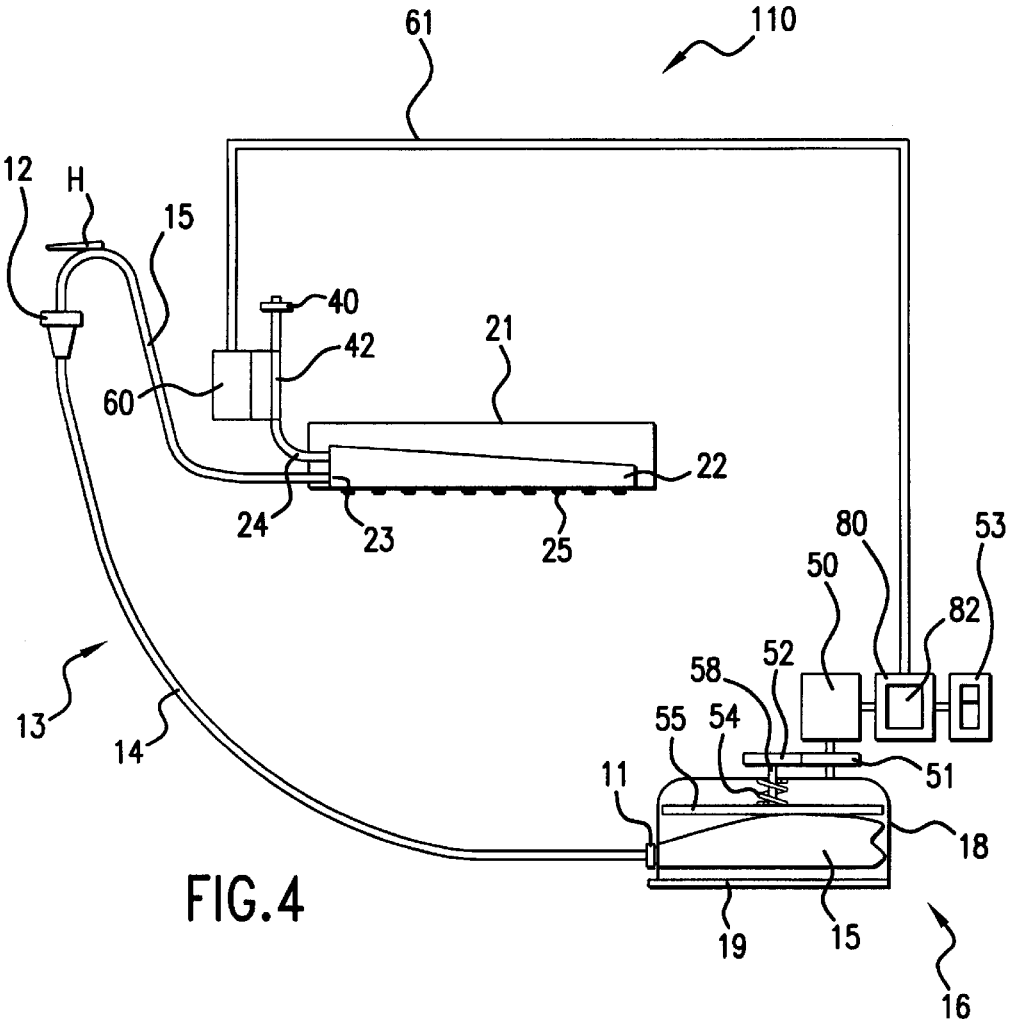
FIG. 4 shows one exemplary embodiment of an automatic positive pressure ink filling apparatus of this invention.

FIG. 4 shows one exemplary embodiment of an automatic positive pressure ink filling apparatus 110 according to this invention. The positive pressure ink filling apparatus 110 includes a motor 50 that provides a motive force to apply pressure against the ink bag 15. The motor 50 is preferably attached to a gear 51. The gear 51 engages a threaded cam 52 inserted through and engaged with a correspondingly threaded hole 58 through the top section 18. A "Fill Printbar" button or switch 53 on a front panel (not shown) of the printer 10 is connected to a controller 80. Pressing the button or switch 53 causes the controller 70 to activate the motor 50. A pressure limiting spring 54 may be provided to maintain the desired positive pressure against the ink bag 15 to fill the ink manifold 22. A pressure structure 55 supported by the threaded cam 52 is preferably provided to actually place pressure on the ink bag 15.

A reflective light sensor 60 may be used to detect the level of ink in the ventline window 42. The sensor 60 is also preferably capable of sending a signal, for example through a signal line 61, to the controller 80 to deenergize the motor 50. A delay device 82 is preferably included in the controller 80 to delay the controller, after receiving the signal from the sensor 60 to deenergize the motor 50, until the printbar ink channels are fully filled and primed.

After replacing the ink supply and/or the printbar, an individual (not shown) switches the "Fill Printbars" switch 53 to the "ON" position. As a result, the motor 50 is turned on, causing the gear 51 to turn, which causes the threaded cam 52 to turn. As the threaded cam 52 turns and moves downward through the correspondingly threaded hole 58, the pressure applicator 55 presses against the bag 15, forcing ink to be expelled into the ink line 14, and eventually into the printbar 21.

Once the reflective light sensor 60 detects ink in the ventline window 42, the printbar 21 is filled with ink. At this time, the signal is sent from the sensor 60 through the signal line 61 to deenergize the motor 50. Once the motor 50 is deenergized, no additional pressure is applied to the ink bag 15. It is also possible to reverse the motor 50 upon deactivation, so that the pressure applicator 55 returns partially or completely to its starting position.

Figure 5:
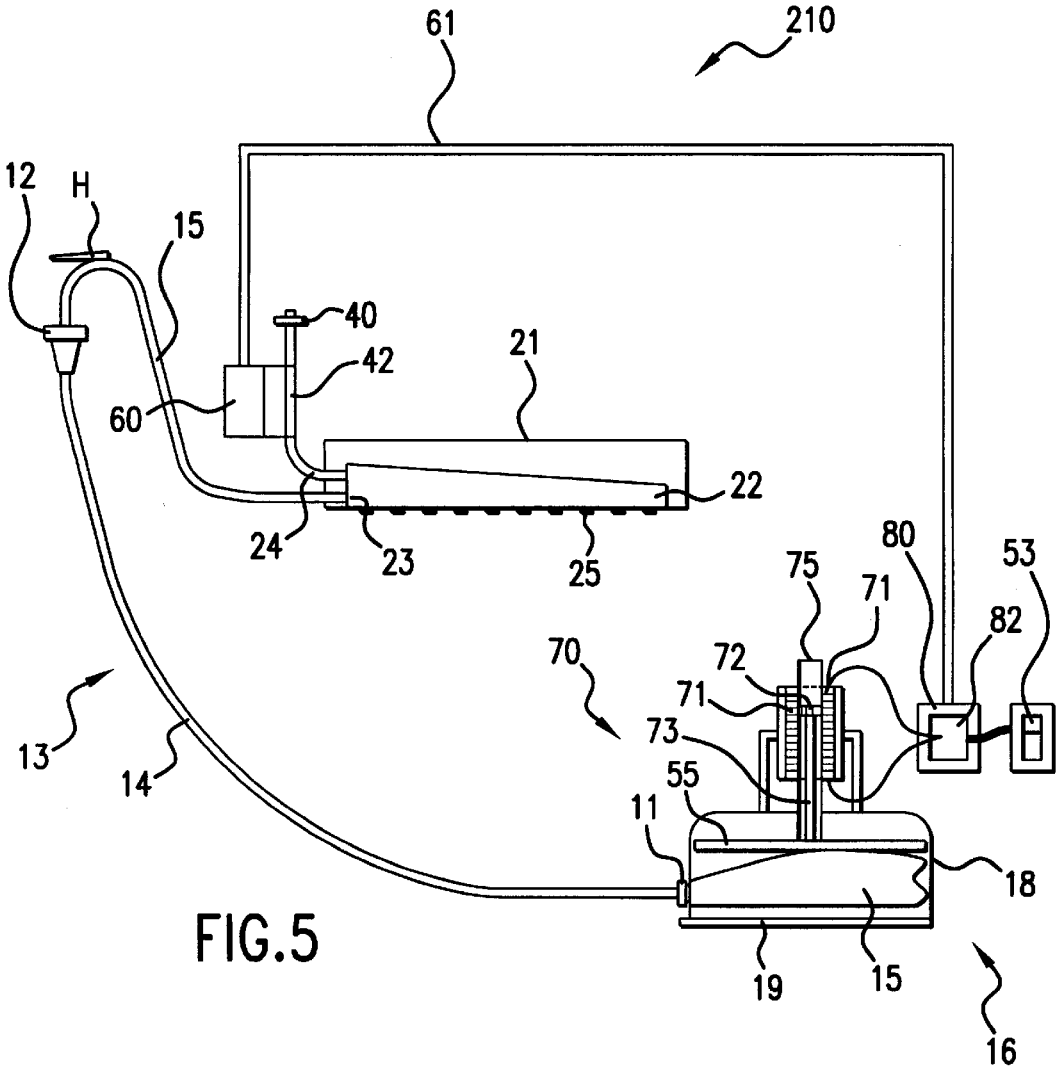
FIG. 5 shows another exemplary embodiment of an automatic positive pressure ink filling apparatus of this invention.

FIG. 5 shows another exemplary embodiment of an automatic positive pressure ink filling apparatus 210 according to this invention. The positive pressure ink filling apparatus 210 includes, for example, a solenoid 70 that provides a motive force to apply pressure against the ink bag 15. The solenoid 70 preferably includes a winding 71 surrounding a ferromagnetic core 75. The pressure structure 55 is connected to one end of the ferromagnetic core 75. The "Fill Printbar" button or switch 53 on the front panel (not shown) of the printer 10 is used to activate the solenoid 70. The solenoid 70, when activated, is supplied with a current that generates a downwardly pointing magnetic field as it flows through the winding 71. This magnetic field applies a downward force to the ferromagnetic core 75, forcing the pressure structure 55 against the ink bag 15. As the pressure applicator 55 moves downward, the pressure applicator 55 presses against the bag 15, forcing ink to be expelled into the ink line 14, and eventually into the printbar 21. Again, a reflective light sensor 60 is preferably used to detect the level of ink in the ventline window 42, and a delay device 82 is preferably included in the controller 80 to delay deenergizing the solenoid 70 until the printbar ink channels are fully filled and primed. Once the solenoid 70 is deenergized, no additional pressure is applied to the ink bag 15. The solenoid 70 can also be supplied with a spring (not shown) so that, upon deactivation, the pressure applicator 55 returns partially or completely to its starting position.

Figure 6:
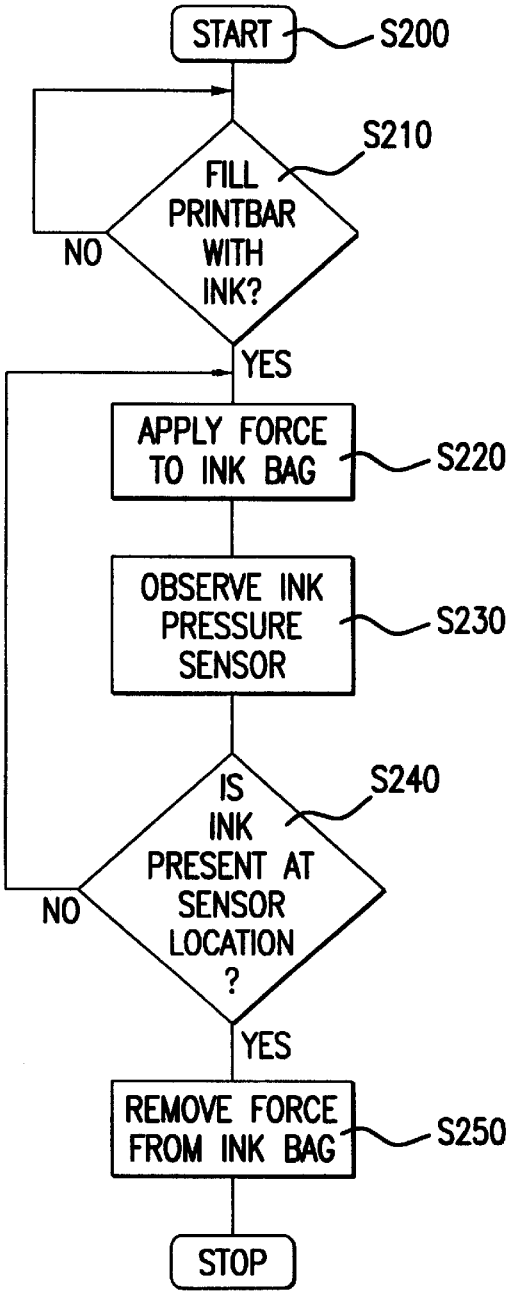
FIG. 6 is a flowchart outlining one exemplary embodiment of an automatic positive pressure ink filling method of this invention.

FIG. 6 outlines another exemplary embodiment of the method for filling the printbar with ink using positive pressure according to this invention. Beginning in step S200, the method continues to step S210, where a determination is made whether the print bar is to be filled with ink. If the print bar is to be filled with ink, control continues to step S220. Otherwise, control returns to step S210.

In step S220, force is applied to the ink bag. Next, in step S230, the ink level window is observed. Control then continues to step S240.

In step S240, a determination is made whether ink is present in the ink level window.

If the ink is not present in the ink level window, control jumps back to step S220. Otherwise control continues to step S250.

In step S250, the force is removed from the ink bag. Then in step S260, the method ends. It should be appreciated that the time between performing steps S240 and S250 can be delayed sufficiently to allow the ink channel to fill with ink. Alternatively, step S250 can occur immediately after step S240 directs the method to step S250.

Figure 7:
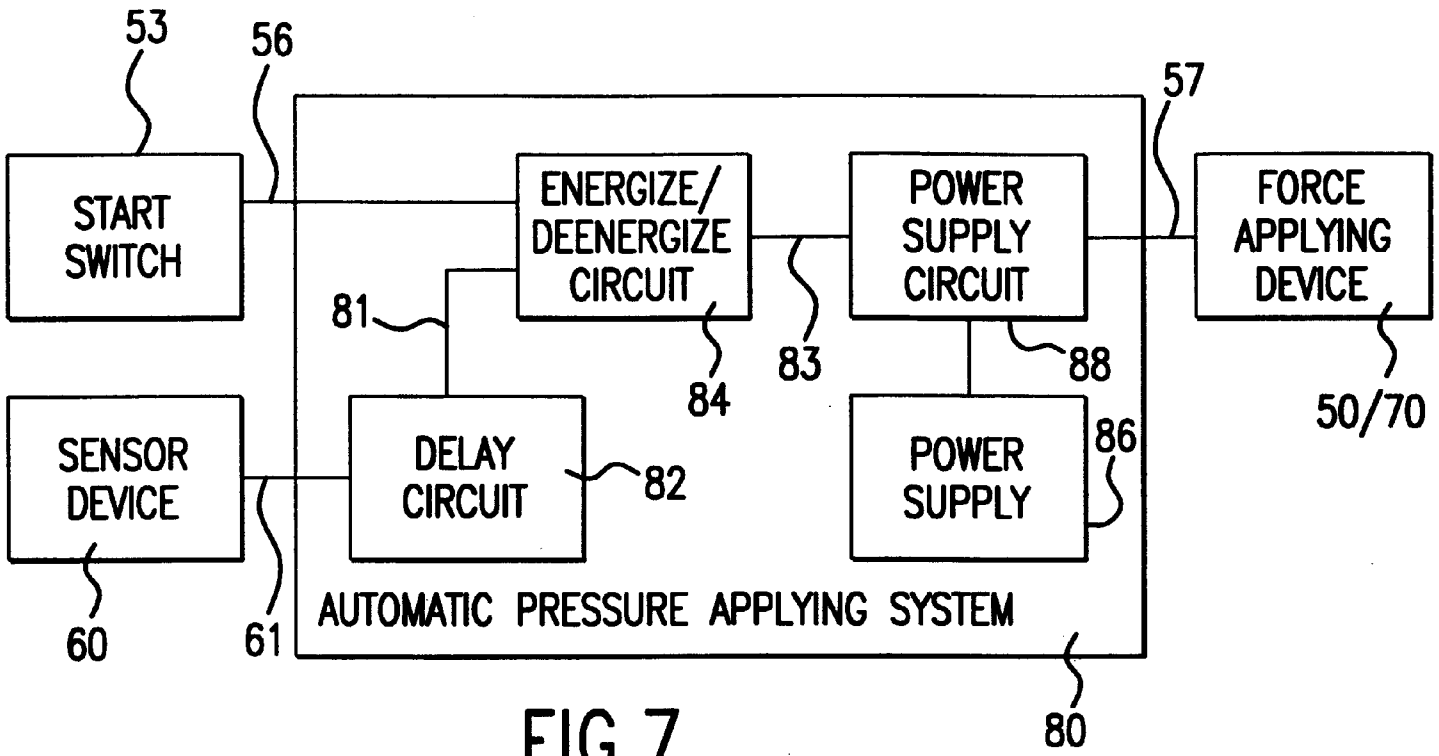
FIG. 7 shows one exemplary embodiment of a controller for the automatic positive pressure ink filling apparatus of this invention.

FIG. 7 shows one exemplary embodiment of the automatic pressure applying system 80 according to this invention. As shown in FIG. 7, the start switch 53 and the reflective light sensor or more generally, the sensor device 60 are connected to the automatic pressure applying system 80 over the signal lines 56 and 61, respectively, as outlined above. In particular, as shown in FIG. 7, the signal line 56 is connected to an energized/deenergize circuit 84, while the signal line 61 is connected to the delay circuit 82.

As outlined above, the delay circuit 82 provides a time delay between output of the sensor signal from the sensor device 60 over the signal line 61 to the energized/deenergize circuit 84 receiving the signal from the sensor device 60. In particular, the delay circuit 82 is an RC circuit or any other known or later developed circuit that is able to provide a predetermined or selectable time delay. The delay circuit 82 can also be a loadable up counter, a loadable down counter or a monostable multivibrator.

The energized/deenergize circuit 84 receives the signal from the sensor device 60 from the delay circuit 82 over a signal line 81. The energized/deenergize circuit 84 can be any known or later developed bistable circuit that will switch between outputting a control signal on the signal line 83 to a power supply circuit 88 in response to receiving a start signal from the start switch over the signal line 56 and removing the control signal from the signal line 83 in response to receiving the sensor signal from the sensor device 60 over the signal line 81. Accordingly, the energize/deenergize circuit 84 can be a set-reset (S/R) flip-flop, a D-type flip-flop or a J-K filp-flop.

The power supply 86 outputs a supply of power at a voltage appropriate for the particular force applying device. The power supply circuit 88 alternately connects and disconnects the power supply 86 to the signal line 57, which is connected to the force supplying device 50 or 70 based on the signal on the signal line 83. The power supply circuit 88 can be implemented using a power transistor or the like.

Figure 8:
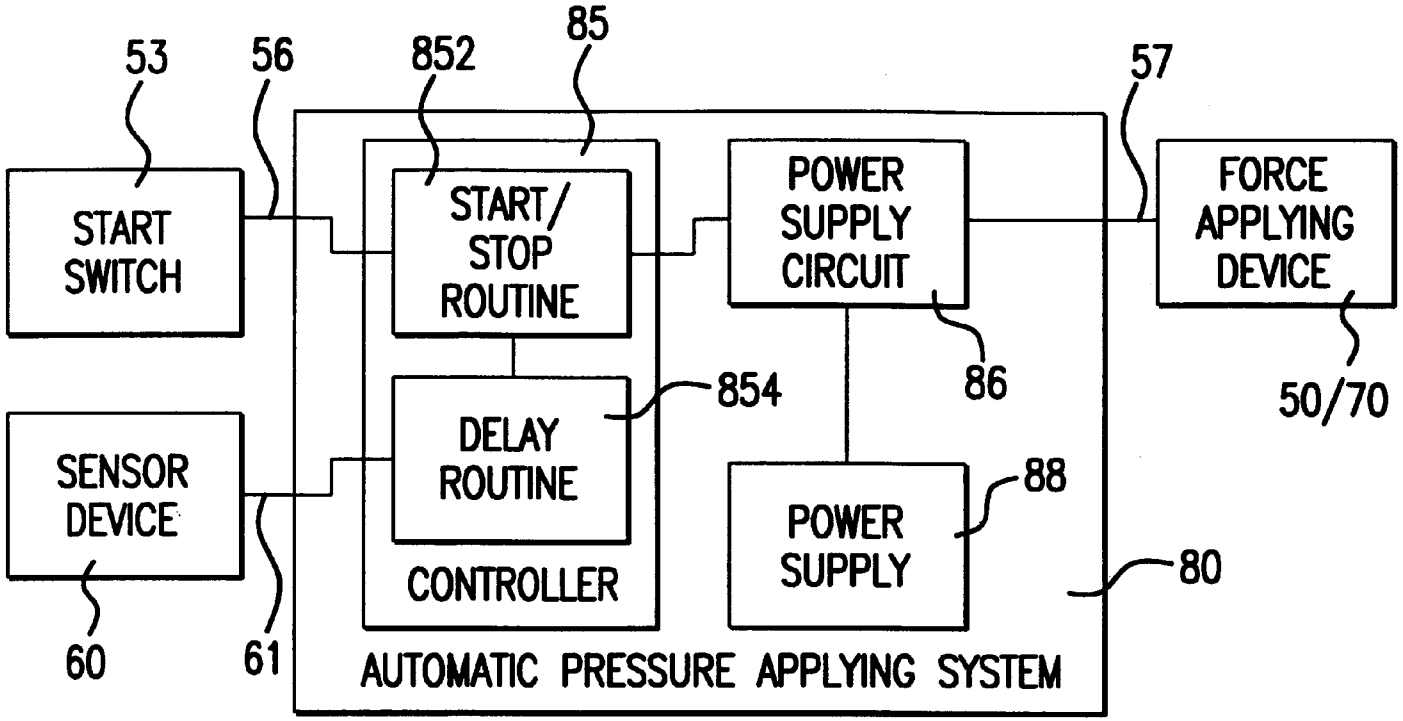
FIG. 8 shows another exemplary embodiment of the controller for the automatic positive pressure ink filling apparatus of this invention.

FIG. 8 shows another exemplary embodiment of the automatic pressure applying system 80. In particular, as shown in FIG. 8, the automatic pressure applying system includes a programmed controller 85. The programmed controller 85 can be implemented using a programmed microcontroller or microprocessor. The programmed controller 85 includes two independent routines. The start/stop routine 852 begins running upon receiving a signal from the start switch 53 over the signal line 56. In particular, the signal line 56 can be connected to an interrupt input or a sampleable data input/output port or data input port of the programmed controller 85. Once the start/stop routine 852 begins running, the start/stop routine 852 outputs a signal over a data input/output port or a data output port to which the signal line 83 is connected.

Similarly, the delay routine 854 can be executed based on a signal from the sensor signal 60 transmitted over the signal line 61 to a different interrupt input or a different data input/output port or data input port of the programmed controller 85. In response to the signal from the sensor device 60 being received by the controller 85, the delay routine 854 is executed for a predetermined delay, then executes an instruction that causes the start stop routine 852 to stop executing. Then, either in response to the start/stop routine 852 stopping executing or in response to the delay routine 854 executing a particular instruction, the output port to which the signal line 83 is connected is turned off, thus removing the control signal from the signal line 83.

While the programmed controller 85 has been described in very general terms, one of ordinary skill in the art would appreciate there is an essentially unlimited number of ways in which a microprocessor or microcontroller may be used to implement the programmed controller 85. For example, the programmed controller 85 could be programmed to respond to the signals received from the start switch 53 and the sensor device 60 over the signal lines 56 and 61 to controllably replace and remove a control signal onto and from the signal line 83.

The ink container 16 preferably includes a replaceable ink bag 15, which may be, and preferably is, a foil laminate bag of conventional type. However, any other suitable materials may be used as long as a sufficient positive pressure force can be applied against the ink in the ink container to force the ink out of the ink container and over the static head height. The ink bag preferably has a low permeability to both moisture and air.

It should also be appreciated that, for a multi-color ink printer, one positive pressure ink filling apparatus could be provided for each differently colored ink. It should also be appreciated that while this invention has been described particularly for a full width array printer, any suitable printing device can be used, including plotters and printers having an off-carriage ink supply system or having an off-printhead ink supply system.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A method for filling a liquid ink printing device, comprising:

providing a compressible container containing an amount of ink;

connecting the compressible container to the printing device;

selectively applying an amount of pressure to compress the compressible container, a portion of the ink expelled from the compressible container in response to the applied pressure, the portion of the ink flowing into the printing device; and removing the applied pressure once a desired portion of ink has been expelled from the compressible container and flowed into the printing device.

2. The method of claim 1, wherein the liquid ink printing device is a printer having a full width array printbar and an ink container for containing at least a portion of the ink expelled from the compressible container and flowed into the printing device.

3. The method of claim 1, wherein the liquid ink printing device is a plotter or a printer having an off-carriage ink supply system or having an off-printhead ink supply system.

4. The method of claim 1, wherein the compressible container is a bag.

5. The method of claim 1, wherein the ink-jet printing device includes a vent line having a sight level window.

6. The method of claim 5, wherein selectively applying the amount of pressure comprises applying a sufficient additional amount of pressure until ink appears in the sight level window.

7. The method of claim 6, wherein selectively applying the amount of pressure comprises applying a further additional amount of pressure sufficient to cause a plurality of channels in the ink bar to become primed.

8. The method of claim 1, wherein selectively applying the amount of pressure comprises providing power to a powered motive source to compress the compressible container.

9. The method of claim 8, wherein the powered motive source is a solenoid.

10. The method of claim 8, wherein the powered motive source is a motor.

11. The method of claim 10, wherein the motor drives a gear and a cam to apply the amount of pressure.

12. The method of claim 1, further comprising determining a level of ink within the printer device.

13. The method of claim 1, wherein selectively applying the amount of pressure comprises applying a further additional amount of pressure sufficient to cause a plurality of printhead ink channels in the printer to become primed.

14. An ink handling apparatus usable in a liquid ink printing device, comprising:

a compressible container holding ink;

a connector fluidly connecting the container with the printing device; and a pressure applicator for selectively applying an amount of pressure to the container sufficient to compress the compressible container to force ink out of the compressible container and into the printing device.

15. The apparatus of claim 14, wherein the compressible container is a bag.

16. The apparatus of claim 14, wherein the printing device includes a vent line having a sight level window.

17. The apparatus of claim 16, further comprising a sensor for detecting ink in the vent line.

18. The apparatus of claim 14, wherein the pressure applicator comprises a powered device that applies the amount of pressure to the container.

19. The apparatus of claim 18, wherein the powered device is a solenoid.

20. The apparatus of claim 18, wherein the powered device is a motor.

21. The apparatus of claim 20, wherein the powered device further includes a gear and a cam.

22. The apparatus of claim 18, further comprising a controller for energizing and deenergizing the powered device.

23. The apparatus of claim 14, wherein the printing device is a full width array printer having a printbar and an ink container for containing the ink expelled from the compressible container.

* * * * *